US005642778A

United States Patent [19]

Gentry

[11] Patent Number: 5,642,778

[45] Date of Patent: Jul. 1, 1997

[54] ROD BAFFLE HEAT EXCHANGERS

[75] Inventor: Cecil C. Gentry, Bartlesville, Okla.

[73] Assignee: Phillips Petroleum Company, Bartlesville, Okla.

[21] Appl. No.: 630,086

[22] Filed: Apr. 9, 1996

[51] Int. Cl.[6] ..... F28F 9/00

[52] U.S. Cl. ..... 165/162; 165/910; 165/DIG. 424; 165/DIG. 425; 165/DIG. 401

[58] Field of Search ..... 165/162, 910, 165/DIG. 425, DIG. 424, DIG. 413, DIG. 412, DIG. 405, DIG. 401

[56] References Cited

U.S. PATENT DOCUMENTS

| | | | |
|---|---|---|---|
| 1,882,474 | 10/1932 | Black | 165/162 |
| 3,104,218 | 9/1963 | Speidel et al. | 165/162 |
| 4,127,165 | 11/1978 | Small | 165/162 |
| 4,136,736 | 1/1979 | Small | 165/162 |
| 4,286,366 | 9/1981 | Vinyard | 29/157.4 |
| 4,637,455 | 1/1987 | Tordonato | 165/162 |
| 4,660,631 | 4/1987 | Small | 165/162 X |
| 4,895,204 | 1/1990 | Johnson et al. | 165/162 |
| 5,058,664 | 10/1991 | Gentry | 165/DIG. 412 X |
| 5,139,084 | 8/1992 | Gentry | 165/162 |

FOREIGN PATENT DOCUMENTS

| | | | |
|---|---|---|---|
| 0122544 | 10/1984 | European Pat. Off. | 165/162 |
| 2027968 | 6/1970 | Germany | 165/162 |
| 0150798 | 6/1989 | Japan | 165/162 |
| 0764838 | 1/1957 | United Kingdom | 165/162 |

*Primary Examiner*—John Rivell
*Assistant Examiner*—Christopher Atkinson
*Attorney, Agent, or Firm*—Ryan N. Cross

[57] ABSTRACT

An improved rod baffle heat exchangers is disclosed in which the tube bundle comprises a plurality of tubes supported intermediate therein by at least one outer ring and a plurality of baffle rods extending along diagonal lanes between the tubes.

9 Claims, 10 Drawing Sheets

ROD BAFFLE HEAT EXCHANGERS

The present invention relates generally to heat exchangers, and more particularly, but not by way of limitation, to rod baffle heat exchangers.

Rod baffle heat exchangers are shell and tube type heat exchangers utilizing rod baffles to support the tubes and secure them against vibrations. Additionally, rod baffles can be used to correct shell-side flow real distributions and to create a more turbulent shell-side flow. The term "baffle" refers to an annular ring in which the ends of a plurality of support rods are connected; hence the term "rod baffle".

In certain applications, such as surface condensers and power plant applications, it is critical to minimize longitudinal-flow, shell-side pressure losses within a rod baffle heat exchanger. Reduction in shell-side pressure losses may be accomplished by increasing rod baffle spacing, thereby reducing the number of rod baffles, or by decreasing the number of tubes which increases the tube pitch dimension, i.e., the distance between two adjacent rows of tubes as measured from the center of the tubes. Increasing baffle spacing is usually not a viable option, since increased baffle spacing increases the likelihood of flow-induced tube vibration occurrence. Decreasing the tube count by increasing tube pitch dimension would produce decreased shell-side pressure loss for longitudinal-flow between rod baffles, but it requires oversized support rod diameters, which in conventional rod baffle designs must be equal to tube pitch minus tube outer diameter. This increase in support rod diameter produces increased rod baffle pressure loss contributions, which can offset any decrease in longitudinal-flow, shell-side pressure loss attributed to reduce tube count. It, therefore, would be advantageous to reduce the longitudinal-flow, shell-side pressure loss in a rod baffle heat exchanger without significantly increasing the rod baffle pressure loss contribution and without increasing the likelihood of flow induced tube vibration occurrence.

SUMMARY OF THE INVENTION

It is one object of this invention to provide a rod baffle heat exchanger having a reduced shell-side pressure loss compared to prior rod baffle heat exchangers while avoiding any increase in the likelihood of flow-induced tube vibration occurrence.

It is another object of this invention to increase the tube pitch dimension of a rod baffle heat exchanger without a significant increase in the longitudinal-flow, shell-side pressure loss contributions of the support rods.

In accordance with this invention there is provided a rod baffle for supporting a plurality of heat exchange tubes wherein said tubes have a common axis of alignment and are positioned at a pitch so as to form a plurality of parallel major tube rows and a plurality of parallel major tube columns such that a plurality of diagonal lanes is formed between adjacent tubes. The diagonal lanes are such that they do not run parallel to the tube rows or tube columns and have a width which is less than the distance between adjacent tube columns and the distance between adjacent tube rows. The rods of the rod baffle are fixedly secured at each end to the outer ring of the rod baffle so that each of the rods extend along one of the diagonal lanes so as to be in supportive contact with each tube adjacent to the diagonal lane. In accordance with another aspect of the invention, there is provided a heat exchanger utilizing the aforementioned rod baffle configuration wherein the tubes are arranged at a square pitch so that the diagonal lanes run at a 45 degree angle from the parallel tube rows and the parallel tube columns.

DETAILED DESCRIPTION OF THE INVENTION

Figure 1:
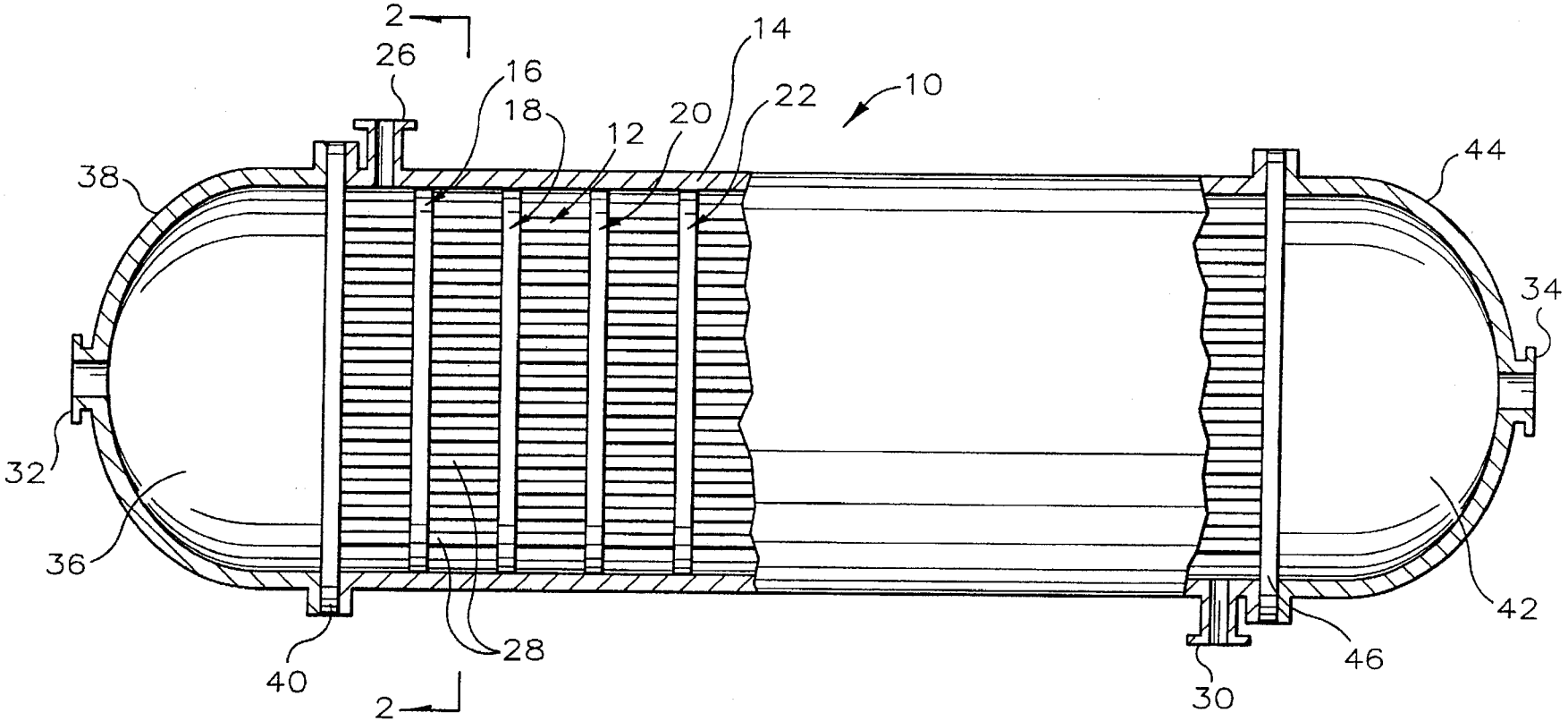
FIG. 1 is a side elevation view of a shell and tube heat exchanger constructed in accordance with the invention with portions of the shell broken away to more clearly illustrate the internal structure.

Referring now to the drawings, and to FIG. 1 in particular, there is illustrated a shell and tube heat exchanger 10. A rod baffle tube bundle 12 is surrounded by shell 14. The tubes in the tube bundle 12 are supported by a plurality of rod baffle assemblies 16, 18, 20, and 22. One fluid enters the shell-side of the shell and tube heat exchanger 10 through an inlet 26 and after heat exchange with the fluid in tubes 28 leaves the shell-side via outlet 30. The fluid flowing through the tube side of the heat exchanger enters the end cap 38 of the heat exchanger via inlet 32 and leaves the end cap 44 of the heat exchanger via outlet 34. Thus, fluid flows from end chamber 36, which is defined by end cap 38 of the heat exchanger 10 and tube sheet 40, through the tubes 28 and into the opposite end chamber 42, which is similarly defined by the end cap 44 and the other tube sheet 46.

Tubes 28 can be arranged in a square pattern, or square pitch, as is shown in FIGS. 3–7; however, the tubes 28 can also be arranged in other patterns as is further discussed below. The invention will be described with reference to a square pitch tube bundle but it should be understood that the invention is not so limited.

The tubes 28 are kept in position by a plurality of rod baffle assemblies 16, 18, 20, and 22. These rod baffle assemblies, as shown in more detail in FIGS. 2–6; each comprise a plurality of rods 48 and an outer ring 52 which surrounds the tube bundle 12. These rods are rigidly attached, e.g., by welding, to the outer ring 52.

Figure 3:
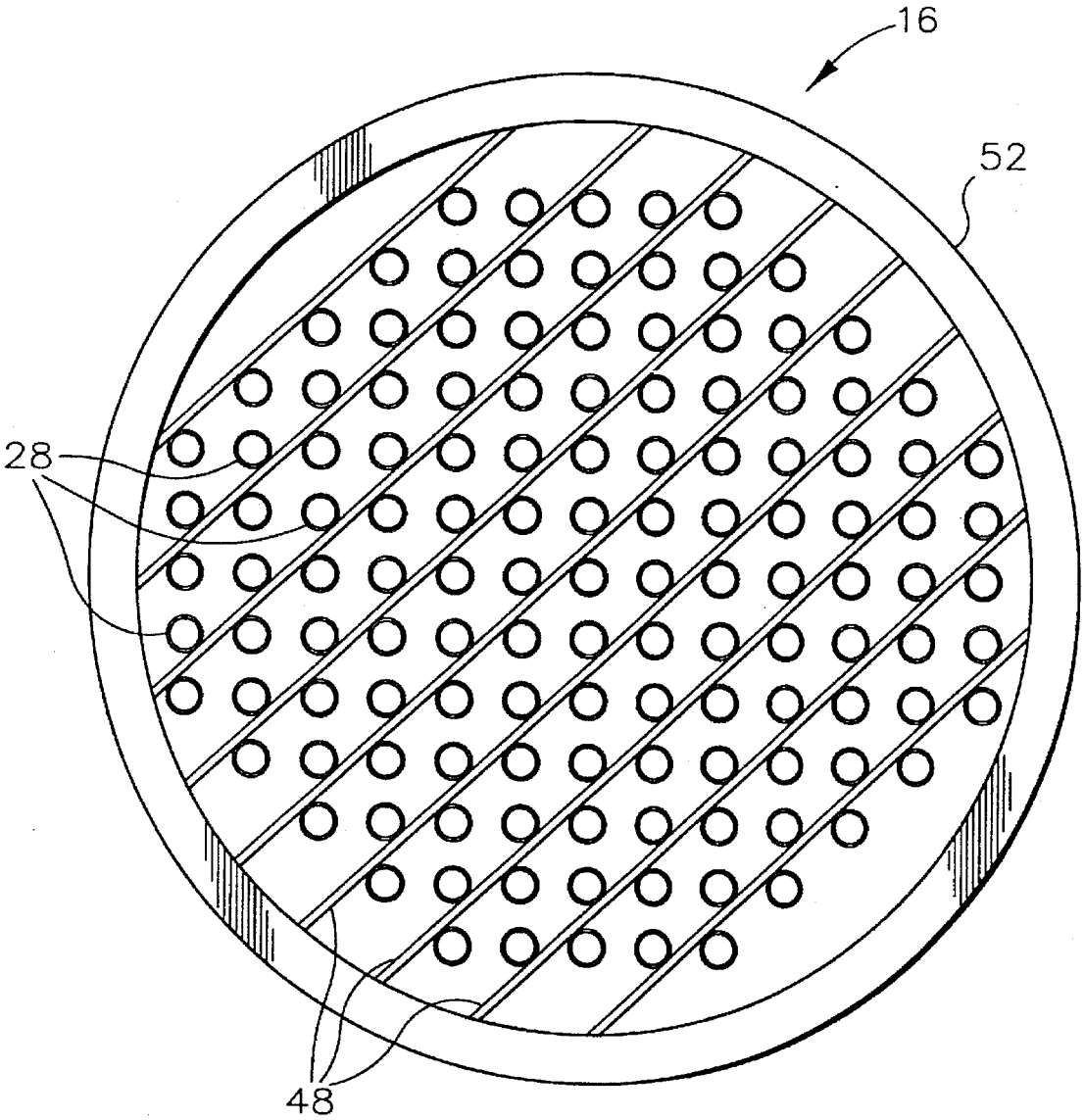
FIG. 3 is a cross-sectional view of rod baffle assembly 16 taken along line 3—3 of FIG. 2.
Figure 9:
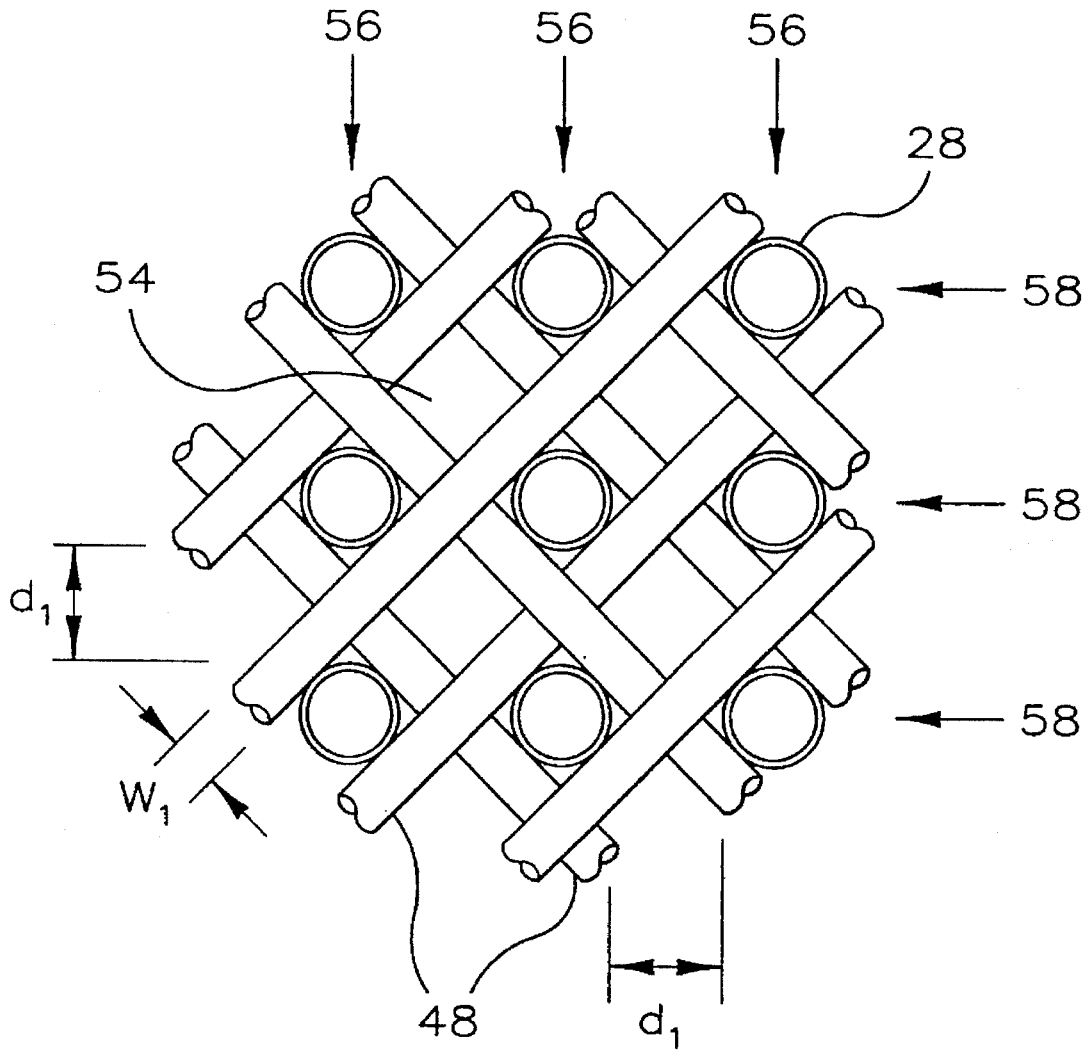
FIG. 9 is an enlarged partial view more clearly illustrating the tube and rod arrangement in the embodiment of FIG. 7.
Figure 10:
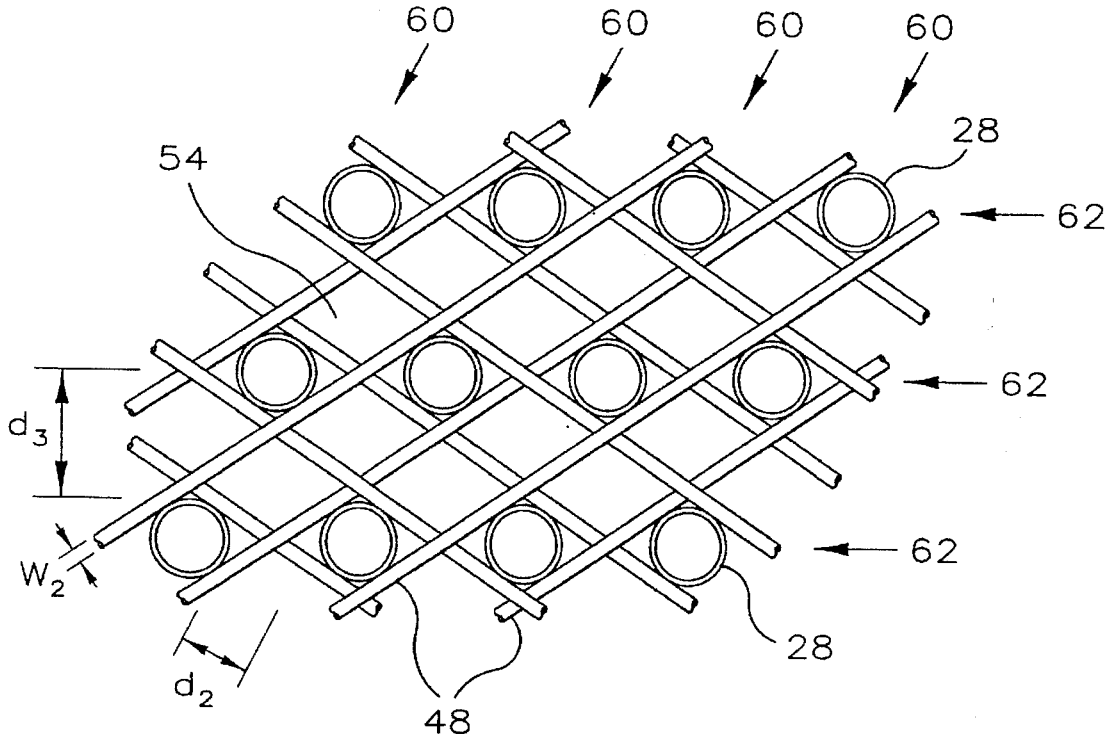
FIG. 10 is a view similar to that of FIG. 9 but of a tube arrangement utilizing a triangular pitch.

The construction of the rod baffle assembly 16 is more clearly illustrated in FIG. 3. The baffle 16 comprises a plurality of diagonally extending baffle rods 48 that are fixedly secured at their opposite ends in the outer ring 52 and are evenly spaced so that they extend along the diagonal lanes formed by adjacent pairs of diagonal tube rows. The positioning of the rods are such that they do not lie parallel to the major tube rows or major tube columns, i.e., the tube rows and columns which have the greatest spaces between adjacent tubes. The major tube rows and major tube columns can better be understood with reference to FIGS. 9 and 10. FIG. 9 illustrates the major tube columns 56 and major tube rows 58 for a square pitch tube layout. FIG. 10 illustrates the major tube columns 60 and major tube rows 62 for a triangular pitch tube layout. Additionally, the rods 48 are spaced so that they extend along alternate diagonal lanes that are formed between the adjacent diagonal tube rows.

Figure 4:
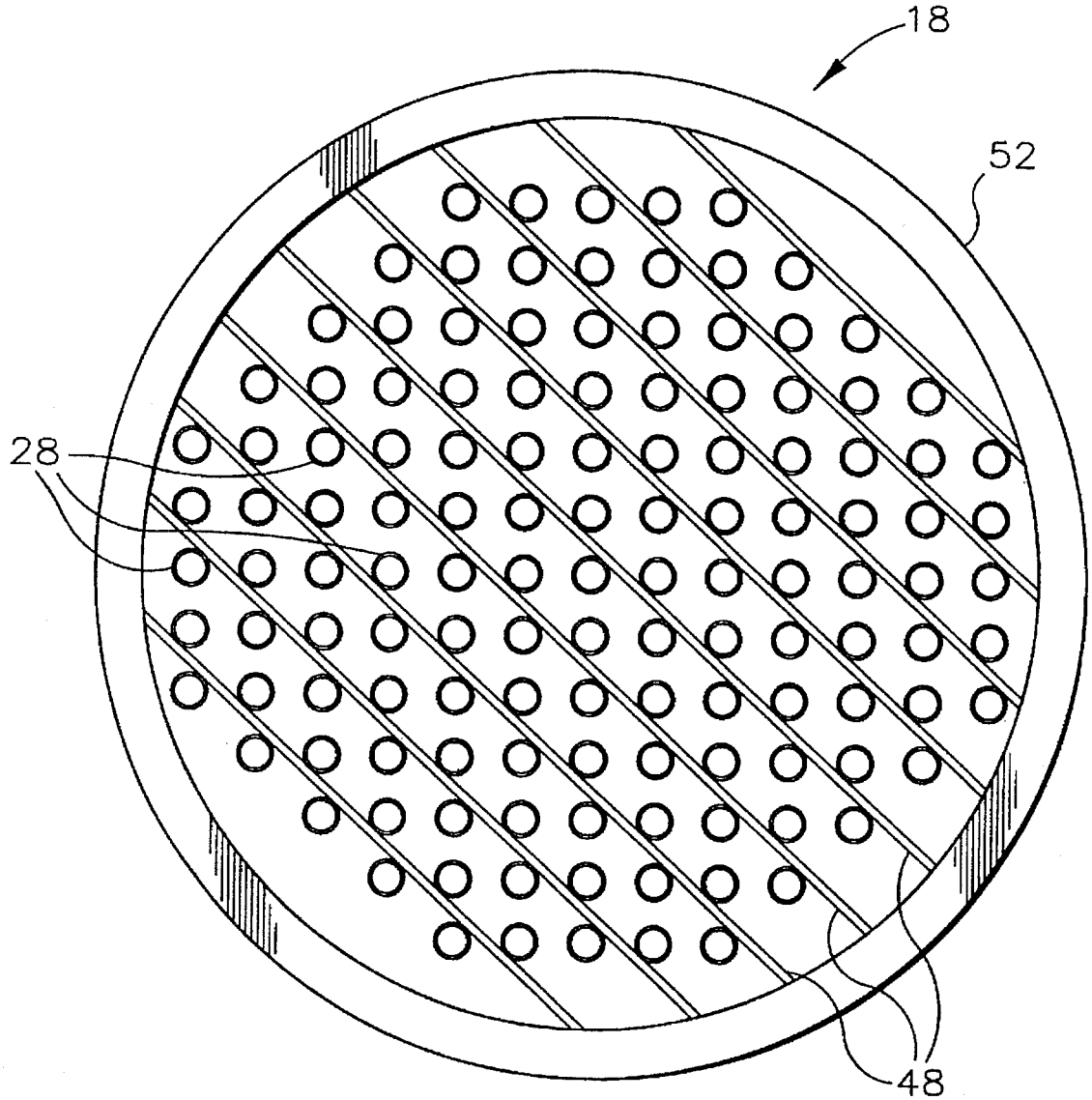
FIG. 4 is a cross-sectional view of rod baffle assembly 18 taken along line 4—4 of FIG. 2.

The construction of the rod baffle assembly 18 is more clearly illustrated in FIG. 4. The baffle assembly 18 comprises a plurality of diagonally extending baffle rods 48 that are fixedly secured at their opposite ends in the outer ring 52 and are evenly spaced so that they extend along the diagonal lanes formed by adjacent pairs of diagonal tube rows. Additionally, rods 48 are positioned so that they extend along alternate diagonal lanes formed by tubes 28 and extend along diagonal lanes which are in opposition to the diagonal lanes utilized for the rods 48 in baffle assembly 16. That is, the rods 48 of baffle assembly 18 extend along diagonal lanes which are not parallel to the diagonal lanes which the rods of baffle assembly 18 extend along. For the square pitch tube arrangement illustrated in FIGS. 3–6, the diagonal lanes utilized in baffle assembly 18 will be perpendicular to those utilized in baffle assembly 16.

Figure 5:
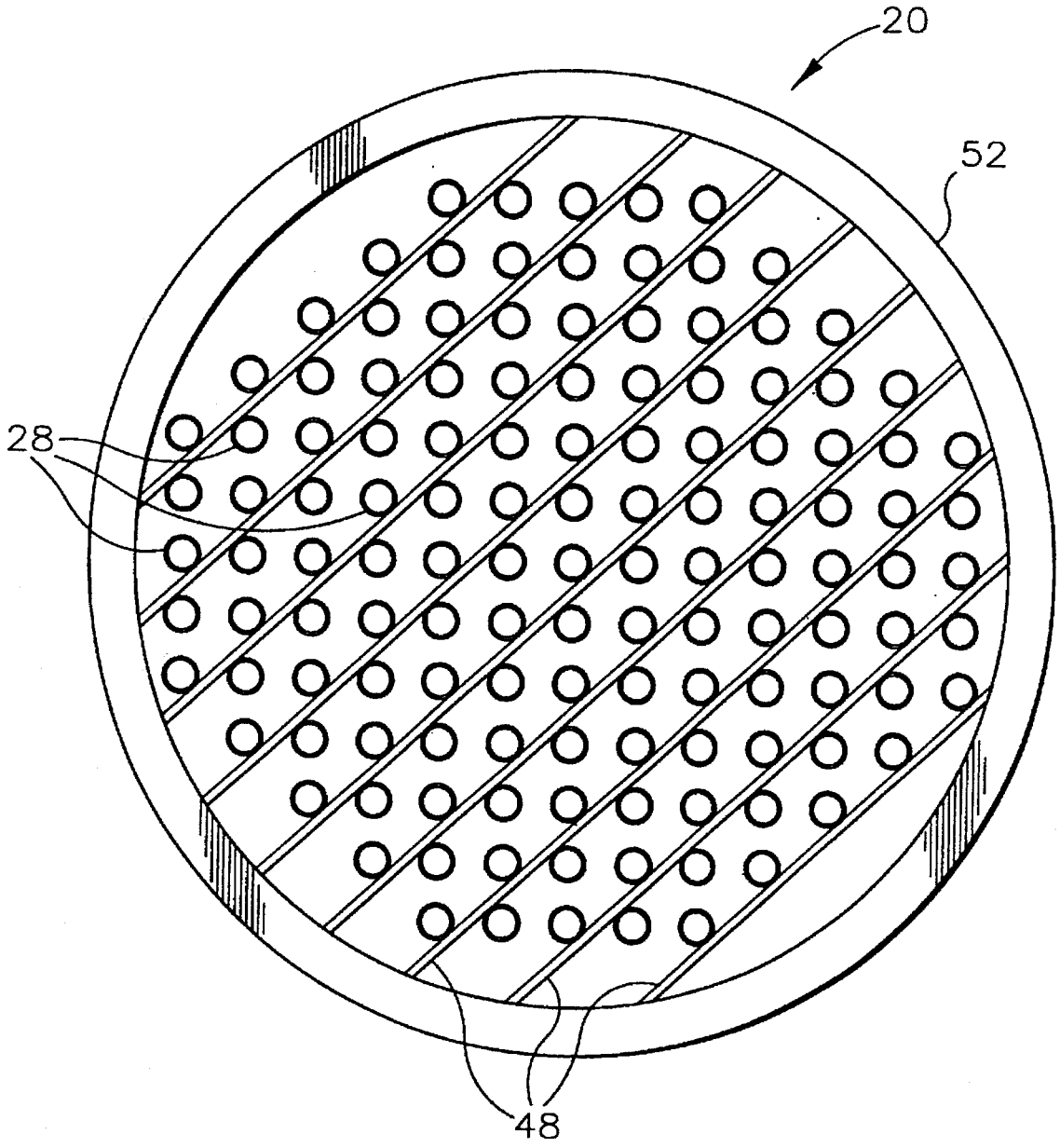
FIG. 5 is a cross-sectional view of rod baffle assembly 20 taken along line 5—5 of FIG. 2.

The construction of rod baffle assembly 20 is more clearly illustrated in FIG. 5. The baffle assembly 20 comprises a plurality of diagonally extending baffle rods 48 that are fixedly secured at their opposite ends in the outer ring 52 and are evenly spaced so as to extend along the diagonal lanes that are parallel to those utilized for rod baffle assembly 16. It will be noted, however, that the diagonal lanes which the rods of rod baffle assembly 20 extend along are not the corresponding diagonal lanes which the rods of rod baffle 16 extend. The rods of rod baffle assembly 20 are positioned to extend along the diagonal lanes which are opened or unbaffled in the rod baffle assembly 16.

Figure 6:
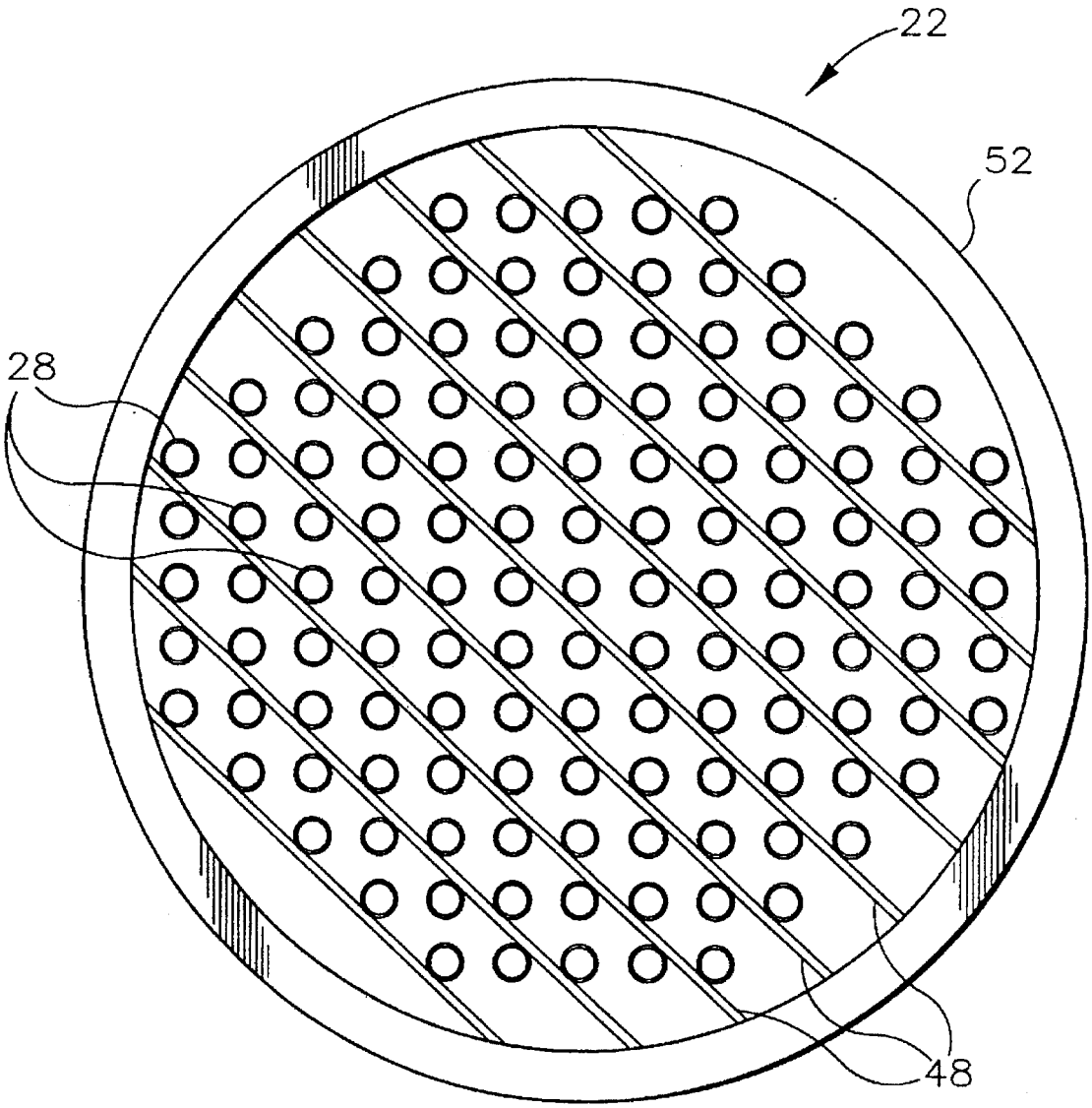
FIG. 6 is a cross-sectional view of rod baffle assembly 22 taken along line 6—6 of FIG. 2.

The construction of rod baffle assembly 22 is more clearly illustrated in FIG. 6. The baffle assembly 22 comprises a plurality of diagonally extending baffle rods 48 that are fixedly secured at their opposite ends in the outer ring 52 and extend along diagonal lanes that are parallel to those utilized for rod baffle assembly 18. It will be noted, however, that the diagonal lanes along which the rods of rod baffle assembly 22 extend are not the corresponding diagonal lanes which the rods of rod baffle assembly 18 extend. The rods of rod baffle assembly 22 are positioned along diagonal lanes which are opened or unbaffled in the baffle assembly 18.

Figure 2:
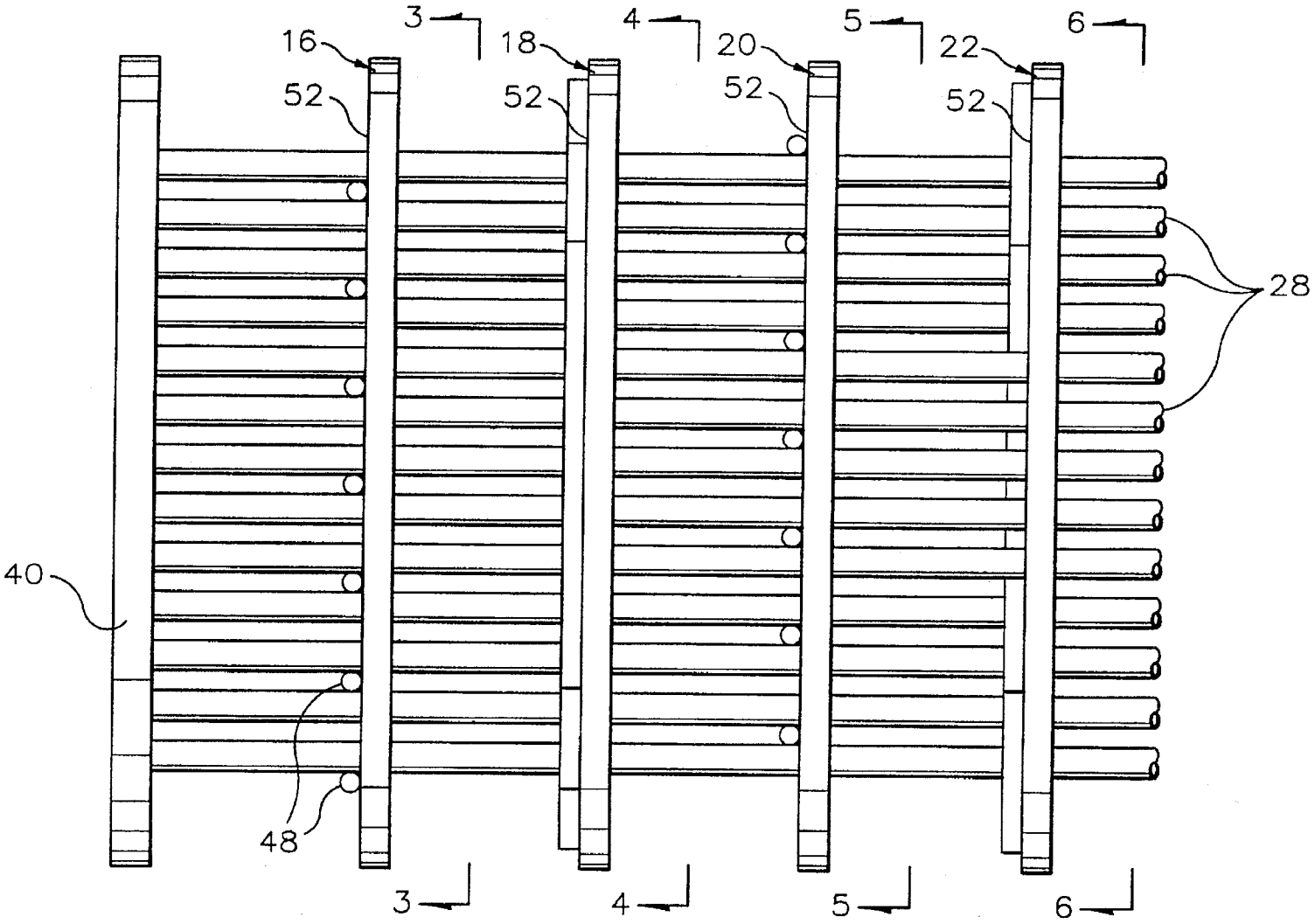
FIG. 2 is an enlarged partial side elevation view more clearly illustrating the tube bundle employed in the embodiment of FIG. 1.

A four baffle set comprising baffle assemblies 16, 18, 20, and 22 is shown in FIG. 2 with the baffle assemblies rotated to show a front view of the rods in assemblies 16 and 20. FIG. 2 shows a plurality of tubes 28 extending from the tube sheet 40 through the first rod baffle assembly 16, the second rod baffle assembly 18, the third rod baffle assembly 20 and the fourth rod baffle assembly 22. Rod baffle assemblies 16 and 20 contain diagonally extending rods which are in opposition to the direction that the rods of rod baffle assemblies 18 and 22 extend, as previously disclosed. The four baffles together provide radial support on four sides of each baffle tube 28.

Figure 7:
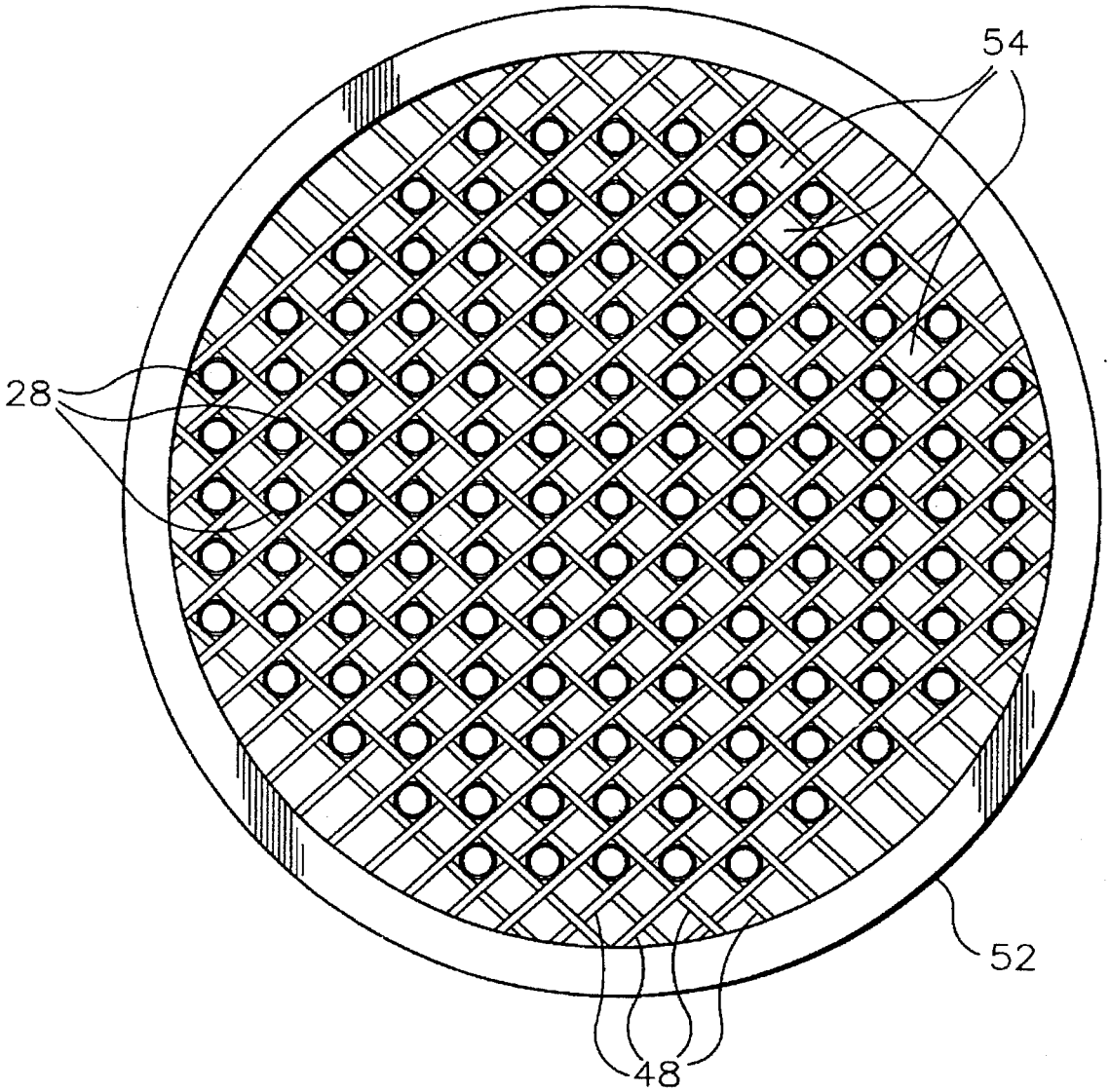
FIG. 7 is a compound illustration of rod baffle assemblies 16, 18, 20 and 22 of FIGS. 3–6, respectively, wherein the composite effects of a four baffle set according to the invention is shown.

A composite picture of baffle assemblies 16, 18, 20, and 22 can be seen in FIG. 7. In FIG. 7 the radial support on four sides of each tube can be better seen. Additionally, it should be noted that the resulting tube support configuration of the four baffle assembly as described above provides for not only radial support of the tubes on all four sides but also areas, or interstices 54 where shell side fluid flow is not directly interrupted by the rods. The effect of these interstices 54 can be better understood by referenced FIG. 8 which illustrates a composite illustration of a traditional four baffle set which utilizes rods running parallel to the horizontal tube rows (the major tube rows) and vertical tube columns (the major tube columns). The rod baffle set of FIG. 8 consists of four baffles, the first one has rods running parallel to the vertical tube columns and between alternating vertical tube columns; the second one has rods running parallel to the horizontal tube rows and extending along alternating horizontal tube rows, the third baffle assembly has rods running parallel to the vertical tube columns and extending between alternating vertical tube columns which are open in the first rod baffle assembly, and the fourth rod baffle assembly which has rods extending parallel to the horizontal tube rows and extending between alternating horizontal tube rows which are open in the second rod baffle assembly.

Figure 8:
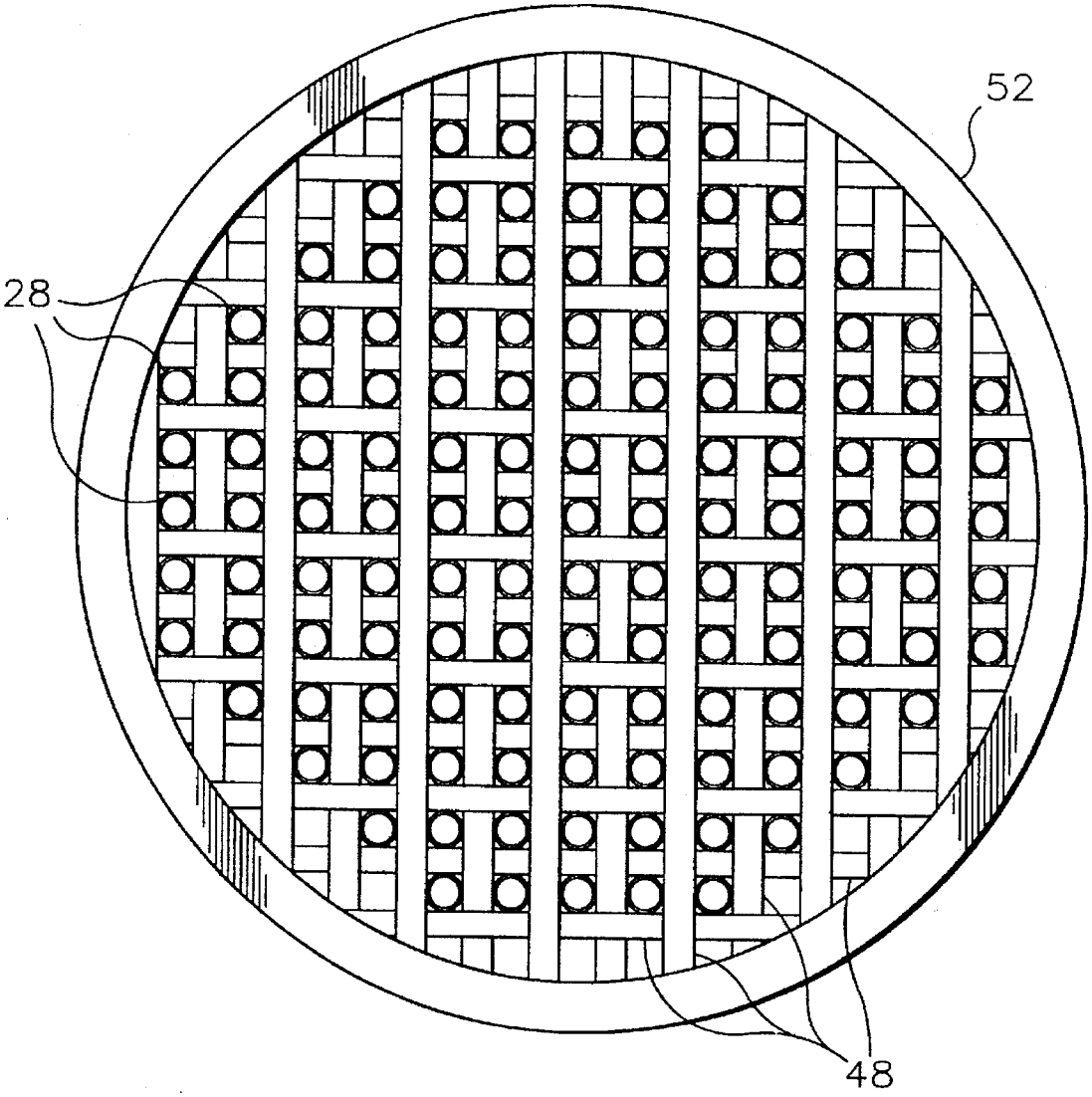
FIG. 8 (PRIOR ART)
FIG. 8 is a compound illustration of four traditional rod baffle assemblies wherein the composite effects of a four baffle set according to the prior art is shown.

A comparison of FIGS. 8 and 7 will illustrate that the traditional four baffle set utilized with a square pitch tube arrangement results in no interstices and must utilize much larger rods for tube support than the rods utilized in FIG. 7 which illustrates a diagonal rod arrangement according to the invention. Thus, the inventive rod baffle assembly can be utilized in a rod baffle heat exchanger wherein the tube pitch dimensions have been increased to provide for a decrease in shell-side pressure loss and, yet, unlike past rod baffle assemblies, such as illustrated in FIG. 8, the inventive rod baffle assembly avoids a significant increase in the longitudinal-flow, shell-side pressure loss contributions of the support rods.

A better understanding of the positioning of the rods for the inventive rod baffle assembly can be obtained with reference to FIG. 9 wherein an exploded view of a section of the tubes and rods of FIG. 7 is illustrated. In FIG. 9 it can be seen that the tubes 28 are positioned to form vertical major tube columns 56 and horizontal major tube rows 58. The rods 48 are positioned to extend diagonally among the tubes 28. Thus, the rods extend along diagonal lanes between the tubes that lie at 45 degree angles to both the horizontal major tube rows 58 and vertical major tube columns 56, and hence, are not parallel to either horizontal tube rows 58 or vertical major tube columns 56. Additionally, the diagonal lanes will have a width $W_1$ that is less than the orthogonal distance $d_1$ between adjacent vertical major tube columns 56 or horizontal major tube rows 58. diagonal lanes will have a width $W_1$ that is less than the orthogonal distance $d_1$ between adjacent vertical major tube columns 56 or horizontal major tube rows 58.

Turning now to FIG. 10 an exploded section of a tube bundle and rod support system similar to that shown in FIG. 9 is illustrated. FIG. 10 further illustrates that the invention can be practiced with tubes that are arranged in other tube pitch patterns besides a square pitch tube arrangement. The tubes 28 of FIG. 10 are arranged in a triangular tube pitch pattern and thus do not have the vertically extending columns of the square pitch arrangement of FIG. 9. Rather, the triangular arrangement of FIG. 10 has diagonal major columns 60 and horizontal major tube rows 62. However, as can been seen from FIG. 10 the support rods 48 can still be arranged to extend along diagonal lanes between adjacent tubes. The diagonal lanes formed between the adjacent tubes of FIG. 10 are diagonal lanes which do not run parallel to either horizontal major tube rows 62 or diagonal major tube columns 60 and have a width $W_2$ which is less than the distance $d_2$ between the adjacent diagonal major tube columns 60 and the distance $d_3$ between adjacent horizontal major tube rows 62.

Although, FIG. 10 illustrates that the inventive baffle assembly can be applied to non-square pitch arrangements of the tubes, it should be understood that the presently preferred arrangement for the tubes is a square pitch arrangement. A square pitch arrangement as illustrated in FIGS. 3–9 is preferred in order to minimize shell-side pressure loss and maximize tube support and the heat exchange efficiency of the tube and shell heat exchanger. It should be noted, in this regard, that a tube arrangement as illustrated in FIG. 10 will utilize diagonal support rods according to the invention with a much smaller diameter than a square pitch tube arrangement having the same distance between adjacent tubes. Therefore, in order to utilize rods that would give the same tube support for the tube arrangement of FIG. 10 as in a square pitch tube arrangement, a much greater spacing between tubes would have to be utilized resulting in a further reduction in the number of tubes.

While the four baffle set shown in the Figures is presently preferred, it is emphasized that the supporting apparatus in accordance with the present invention only requires that the rods in each baffle assembly inserted in the diagonal lanes are inserted into less than the total number of such diagonal lanes for each baffle assembly. It is immaterial whether the rods are inserted in adjacent lanes, alternate lanes, two alternate lanes followed by skipping two lanes or any variation desired.

The minimum number of rods in a baffle assembly is a number sufficient for the baffle set to provide radial support for each tube forming the tube bundle. It is preferred that this functional limitation also be used to determine the maximum number of rods in a baffle assembly because the pressure drop across the shell-side of the shell and tube heat exchanger is the lowest when the least number of rods are used to form the baffle assemblies; however, it is essential to use enough rods in each baffle assembly for the baffle set to provide radial support for each tube. The number of baffles assemblies constituting a baffle set as described above must not be confused with the total number of baffle assemblies used in the tube bundle as this later number can be any number of above the minimum number required in a baffle set and the total number of baffle assemblies in the tube bundle is otherwise independent of the number of baffle assemblies in a baffle set.

It is apparent that the minimum number of baffle assemblies per baffle set is dependent upon the tube layout. While FIGS. 3–9 show a square pitch tube layout, other tube layouts are possible in which the minimum number of baffle assemblies in a baffle set may be other than those specifically discussed. But with any tube layout, at least three baffle assemblies per baffle sets are required to practice the present invention and the specific tube layouts herein discussed are presented for the purposes of illustration and are not intended to limit the broad invention.

A tube bundle constructed in accordance with the present invention can typically include multiple baffle sets such as those shown in FIG. 2. The baffle assembly in any embodiment of the invention can be positioned in a plane which is not perpendicular to the longitudinal axis of the tubes as well as in a plane which is perpendicular to said axis. It is presently preferred to construct the support apparatus of the invention using baffle assemblies which are positioned in a plane perpendicular the longitudinal axis of the tubes because the outer rings 52 can be circular in shape as opposed to the more difficult to construct elliptically shaped rings required for baffle assemblies positioned in a plane which is not perpendicular to the longitudinal axis of the tubes. Of course it will be understood that baffle assemblies positioned in a plane perpendicular to the longitudinal axis of the tubes as well as baffle assemblies positioned in a plane not perpendicular to the said axis are within the scope of the present invention.

Reasonable variations and modifications, which will be apparent to those skilled in the art, can be made in this invention without parting from the spirit and scope thereof.

That which is claimed:

1. A supporting apparatus for a plurality of tubes in the form of a tube bundle suitable for use in a shell and tube heat exchanger, said tubes having a common axis of alignment and positioned in a pitch so as to form a plurality of parallel major tube rows and a plurality of parallel major tube columns such that a plurality of diagonal lanes is formed between adjacent tubes, said diagonal lanes not running parallel to said tube rows or tube columns and having a width which is less than the distance between adjacent tube columns and between adjacent tube rows, comprising:

at least one baffle set providing radial support for each tube and comprising at least one baffle, wherein such baffle comprises;

an outer ring surrounding said tube bundle positioned in a plane which is about perpendicular to said common axis of alignment of said tube bundle; and a plurality of rods each having a first end and a second end wherein each said rod is fixedly secured at its first and second end to said outer ring so that each said outer ring has a plurality of said rods secured thereto in a parallel equally spaced relation, and wherein each of said rods extends along one of said diagonal lanes so as to be in supportive contact with each said tube adjacent to said diagonal lane.

2. An apparatus according to claim 1 wherein said tubes of said tube bundle are positioned in a square pitch and said diagonal lanes having a width which is less than the orthogonal space between said adjacent columns and adjacent rows.

3. An apparatus according to claim 1 wherein said at least one baffle set compromises at least a first baffle and a second baffle with said rods of said first baffle extending along a first set of diagonal lanes and said rods of said second baffle extending along a second set of diagonal lanes which are opposing to said first set of diagonal lanes.

4. An apparatus according to claim 1 wherein said at least one baffle set comprises a four baffle set having a first baffle with rods extending along a first set of said diagonal lanes parallel to each other, a second baffle with rods extending along a second set of said diagonal lanes parallel to each other and opposed to said first set of said diagonal lanes and wherein neither said first baffle nor said second baffle has rods in all of said diagonal lanes of either said set of said diagonal lanes, a third baffle having rods extending along said first set and a fourth baffle with rods extending along said second set and wherein neither said third baffle nor said fourth baffle has rods in all of said diagonal lanes of either said set of said diagonal lanes.

5. Supporting apparatus for a plurality of tubes in the form of a tube bundle suitable for use in a shell and tube heat exchanger, said tubes having a common axis of alignment and positioned in a square pitch so as to form a plurality of parallel major tube rows and a plurality of parallel major tube columns such that a plurality of diagonal lanes is formed at fortyfive degree angles from said tube rows and tube columns between adjacent tubes, comprising:

at least one baffle set providing radial support for each tube and having four baffles, wherein each such baffle comprises;

an outer ring surrounding said tube bundle positioned in a plane which is about perpendicular to said common axis of alignment of said tube bundle; and a plurality of rods each having a first end and a second end wherein each said rod is fixedly secured at its first and second end to one of said outer rings so that each said outer ring has a plurality of said rods secured thereto in a parallel equally spaced relation and wherein each of said rods extends along one of said diagonal lanes so as to be in supportive contact with each said tube adjacent to said diagonal lane and wherein a first baffle of each said baffle set has rods extending along a first set of said diagonal lanes parallel to each other, a second baffle of each said baffle set has rods extending along a second set of said diagonal lanes parallel to each other and perpendicular to said first set of said diagonal lanes and wherein neither said first baffle nor said second baffle has rods in all of said diagonal lanes of either said set of diagonal lanes, a third baffle having rods extending along said first set and a fourth baffle having rods extending along said second set and wherein neither said third baffle nor said fourth baffle has rods in all of said diagonal lanes of either said set of diagonal lanes.

6. An apparatus comprising:

a plurality of parallel tubes with a common axis of alignment arranged in a pitch to form a plurality of parallel major tube rows and a plurality of parallel major tube columns such that a plurality of diagonal lanes is formed between adjacent tubes, said diagonal lanes not running parallel to said tube columns or said tube rows and having a width which is less than the distance between adjacent tube columns or between adjacent tube rows;

at least one outer ring surrounding said plurality of tubes in a plane about normal to said common axis of alignment of said plurality of tubes; and a plurality of rods each having a first end and a second end wherein each said rod is fixedly secured at its first and second end to one of said outer rings so that each said outer ring has a plurality of said rods secured thereto in a parallel equally spaced relation wherein each of said rods extends along one of said diagonal lanes so as to be in supportive contact with each said tube adjacent to said lane.

7. An apparatus according to claim 6 wherein said tubes of said tube bundle are arranged in a square pitch.

8. An apparatus according to claim 6 wherein each said outer ring along with said rods fixedly secured thereto form a member of a four baffle set, said four baffle set having a first baffle with rods extending along a first set of said diagonal lanes parallel to each other, a second baffle with rods extending along a second set of said diagonal lanes parallel to each other and opposed to said first set of said diagonal lanes and wherein neither said first baffle nor said second baffle has rods in all of said diagonal lanes of either said set of diagonal lanes, a third baffle having rods extending along said first set and a fourth baffle with rods extending along said second set and wherein neither said third baffle nor said fourth baffle has rods in all of said diagonal lanes of either said set of diagonal lanes.

9. An apparatus comprising:

a plurality of parallel tubes with a common axis of alignment arranged in a square pitch to form a plurality of parallel major tube rows and a plurality of parallel major tube columns such that a plurality of diagonal lanes are formed between adjacent tubes, said diagonal lanes running at fortyfive degree angles to both said tube columns and said tube rows;

at least one outer ring surrounding said plurality of tubes in a plane about normal to common axis of alignment of said plurality of tubes; and a plurality of rods each having a first end and a second end wherein each said rod is fixedly secured at its first and second end to one of said outer rings so that each said outer ring has a plurality of said rods secured thereto in a parallel equally spaced relation wherein each of said rods extends along one of said diagonal lanes so as to be in supportive contact with each said tube adjacent to said lane and wherein each said outer ring along with said rods fixedly secured thereto form a member of a four baffle set, said four baffle set having a first baffle with rods extending along a first set of said diagonal lanes parallel to each other, a second baffle having rods extending along a second set of said diagonal lanes parallel to each other and perpendicular to said first set of diagonal lanes and wherein neither said first baffle nor said second baffle has rods in all of said diagonal lanes of either said set of diagonal lanes, a third baffle having rods extending along said first set and a fourth baffle with rods extending along said second set of said diagonal lanes and wherein neither said third baffle nor said fourth baffle has rods in all of said diagonal lanes of either said set of diagonal lanes.

* * * * *